US011051642B1

(12) United States Patent
Ho

(10) Patent No.: US 11,051,642 B1
(45) Date of Patent: Jul. 6, 2021

(54) PLASTIC GARMENT HANGER WITH COLLAPSIBLE PLASTIC HOOK

(71) Applicant: Sourcing Solutions International Limited, Kowloon (HK)

(72) Inventor: Leung Ho, Kowloon (HK)

(73) Assignee: Sourcing Solutions International Limited, Kowloon (HK)

( * ) Notice: Subject to any disclaimer, the term of this patent is extended or adjusted under 35 U.S.C. 154(b) by 0 days.

(21) Appl. No.: 15/591,008

(22) Filed: May 9, 2017

(51) Int. Cl.
*A47G 25/40* (2006.01)
*A47G 25/32* (2006.01)

(52) U.S. Cl.
CPC ..... *A47G 25/40* (2013.01); *A47G 25/32* (2013.01)

(58) Field of Classification Search
CPC ..... A47G 25/32; A47G 25/38; A47G 25/40
USPC ..... 40/322; 223/89, 94
See application file for complete search history.

(56) References Cited

U.S. PATENT DOCUMENTS 881,818 A 3/1908 Morrison
1,893,815 A 10/1930 Wilt, Jr.
2,425,527 A 7/1945 Gaudino
3,082,921 A * 3/1963 Sadowsky ..... A47G 25/4023 223/94
3,726,452 A 4/1973 Jaffe
3,790,046 A * 2/1974 Rooney ..... A47G 25/32 223/92
4,063,670 A 12/1977 Faarbech
4,168,791 A 9/1979 Clark, Jr.
4,813,581 A 3/1989 LaMont
4,905,877 A 3/1990 Gatling
4,932,571 A 6/1990 Blanchard
4,997,115 A 3/1991 Jolley
5,007,562 A 4/1991 Brink
5,044,534 A * 9/1991 Hwang ..... A47G 25/4023 211/118
5,074,445 A * 12/1991 Chen ..... A47G 25/32 211/116
5,085,357 A 2/1992 Chen
6,000,587 A 12/1999 Sackett
6,050,460 A * 4/2000 Licari ..... A47G 25/4023 223/94
D518,653 S 4/2006 de Groot
7,021,507 B2 4/2006 Choi
D541,537 S 5/2007 Cresap
7,243,823 B2 7/2007 Cresap
7,246,729 B2 7/2007 Harvey
7,249,699 B2 7/2007 Hill
7,828,179 B2 11/2010 Sprovieri
7,837,074 B2 11/2010 Rude
D631,672 S 2/2011 Kaleta
8,113,393 B2 2/2012 Ho
8,113,394 B2 2/2012 Ho
8,381,952 B2 2/2013 Mainetti
8,523,026 B2 9/2013 Tseng
8,899,454 B2 * 12/2014 Mainetti ..... A47G 25/32 223/85

(Continued)

FOREIGN PATENT DOCUMENTS

WO WO9846107 10/1998

*Primary Examiner* — Nathan E Durham
(74) *Attorney, Agent, or Firm* — Schroeder Law PC

(57) ABSTRACT

A plastic garment hanger having a plastic hook moveable between an upright in-use position for displaying garments and a folded stowage position for reducing the footprint of the hanger during packaging/transportation of pre-hung garments.

9 Claims, 18 Drawing Sheets

(56) References Cited

U.S. PATENT DOCUMENTS

| | | | | |
|---|---|---|---|---|
| 9,113,736 | B1 * | 8/2015 | Antler | A47G 25/32 |
| 9,392,898 | B2 | 7/2016 | Tsukada | |
| 9,445,679 | B2 | 9/2016 | Hansen | |
| 10,111,544 | B1 * | 10/2018 | Bernstein | A47G 25/32 |
| 2012/0241481 | A1 | 9/2012 | Merandi | |
| 2013/0200113 | A1 | 8/2013 | Tashkin | |
| 2014/0158724 | A1 * | 6/2014 | Merandi | A47G 25/4015 223/85 |
| 2015/0230644 | A1 | 8/2015 | Kallet | |
| 2015/0297012 | A1 | 10/2015 | Yamada | |
| 2016/0088964 | A1 | 3/2016 | Hansen | |

* cited by examiner

PLASTIC GARMENT HANGER WITH COLLAPSIBLE PLASTIC HOOK

BACKGROUND OF THE INVENTION

The present invention relates to garment hangers and, more particularly, to a plastic garment hanger having a collapsible plastic hook.

Plastic garment hangers having plastic hooks are well-known in the art. These hangers are typically formed as an integral unit using an injection molding process. Thus, the orientation of the plastic hook is fixed with respect to the plastic body of the hanger.

Many garments that are manufactured oversees are pre-hung on a hanger, and then shipped to the United States as a hanger/garment combination. In other words, the garment is hung on the appropriate hanger at the manufacturing location (e.g., the Far East), packaged into a shipping box or container, and shipped to the United States. Upon delivery to the retail location, the retailer simply has to remove the pre-hung garments from the shipping box/container, and hang such pre-hung garments in the retail store. Thus, there is no need for the retailer to incur time and cost hanging the individual garments on individual hangers.

Although garments can be tightly packed within the mentioned packaging boxes/containers, those skilled in the art will appreciate that the hooks of the garment hangers take up a significant volume of space within such boxes/containers. This additional space, of course, translates into additional shipping costs.

There is therefore a need in the art for a plastic garment hanger having a plastic hook, which in addition to functioning as a conventional garment hanger in a retail location, is also capable of providing a reduced footprint during packaging/transportation.

SUMMARY OF THE INVENTION

The present invention, which addresses the needs of the prior art, provides a garment hanger. The garment hanger includes a plastic body portion for supporting a garment. The garment hanger further includes a plastic support structure extending from an edge of the body portion, the support structure including a hook base and a sizer-engaging web. A portion of the hook base defines an engagement edge. The garment hanger further includes a plastic hook having a rod-engaging end and an opposing base-engaging end, the base-engaging end being non-removably and rotatably connected to the base. The base-engaging end includes a channel sized to receive the engagement edge of the hook base. The hook is rotatable between a first upright in-use position wherein the engagement edge of said hook base is received within the channel of the base-engaging end and a second folded stowage position wherein the engagement edge is separated from the channel.

In one preferred embodiment, the hook defines an overall cross-sectional thickness $Z_2$. The base-engaging end of the hook includes a first attachment section defining a cross-sectional thickness Y and a second edge-engaging section defining a cross-sectional thickness substantially equal to $Z_2$. The channel is located within the second section of the base-engaging end of the hook.

In another preferred embodiment, the support structure defines an overall cross-sectional thickness $Z_1$. At least a portion of the hook base defines a cross-sectional thickness X, wherein $X<Z_1$, $Z_1$ is substantially equal to $Z_2$, and X plus Y is substantially equal to $Z_1$.

As a result, the present invention provides a plastic garment hanger having a plastic hook, which in addition to functioning as a conventional garment hanger in a retail location, is also capable of providing a reduced footprint during packaging/transportation.

and

Figure 11:
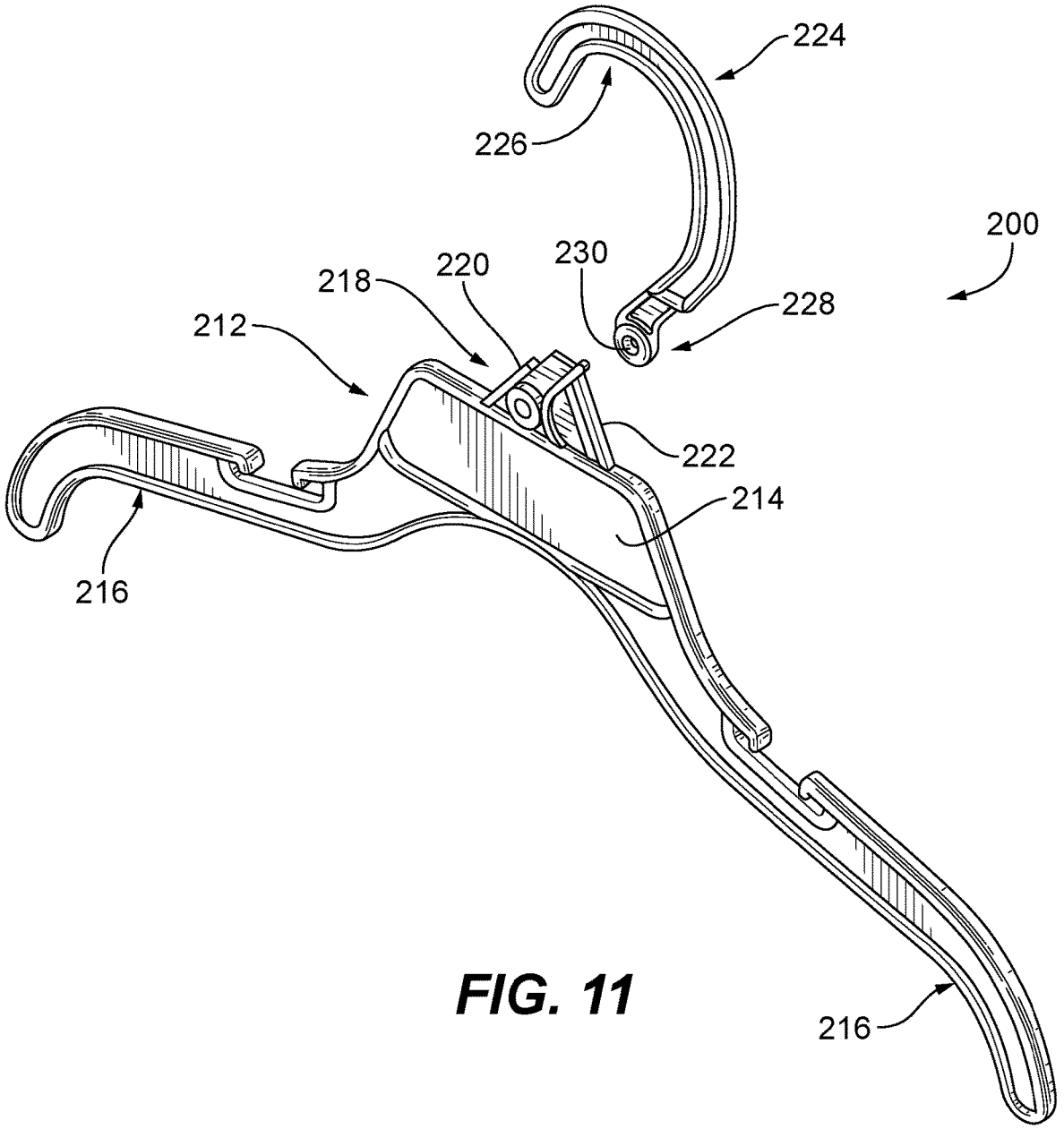
FIG. 11 is a front perspective view of a third embodiment of the plastic garment hanger of the present invention with the plastic hook exploded away from the plastic body.
Figure 19:
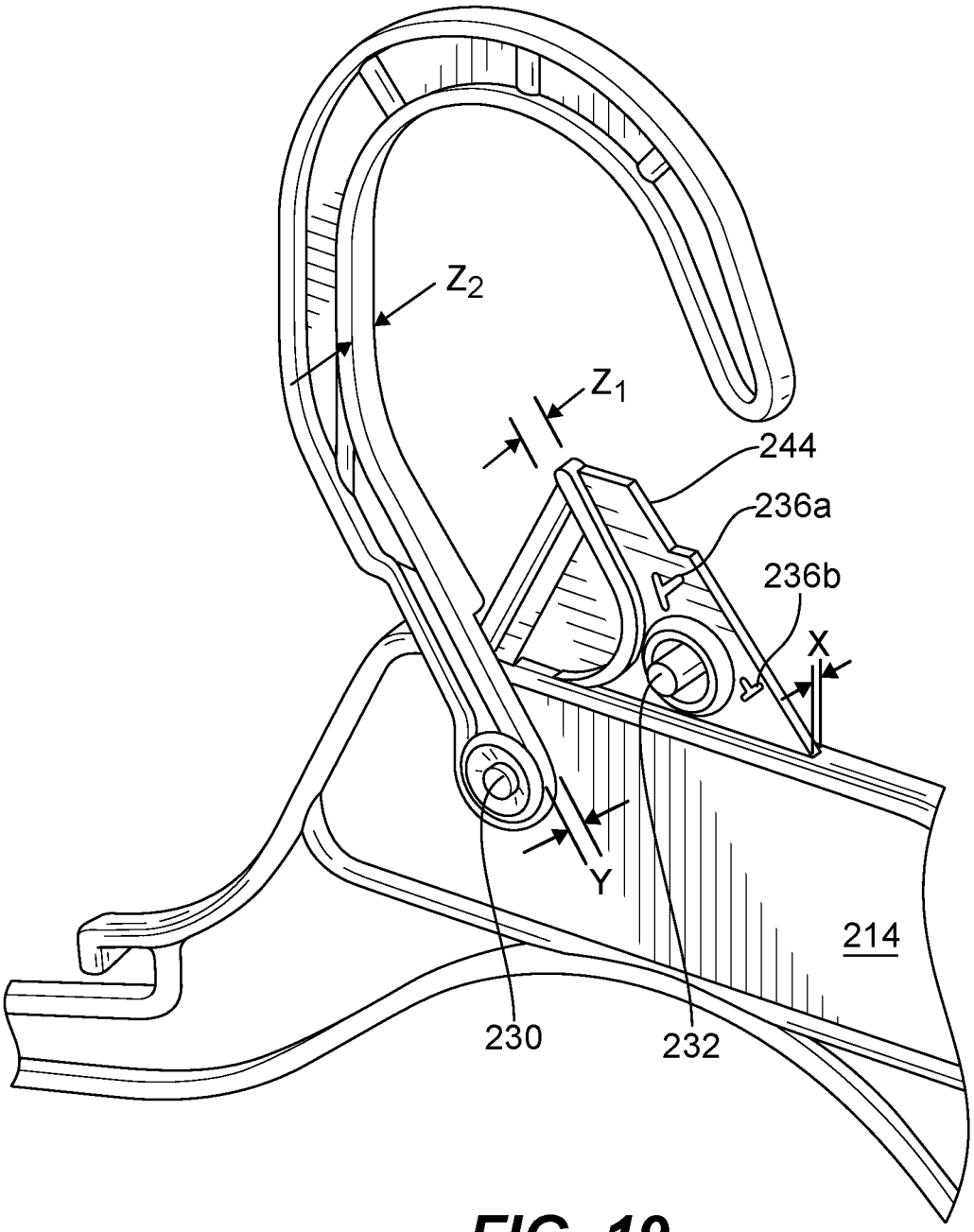

FIG. 19 is an enlarged detail taken from FIG. 11.

DETAILED DESCRIPTION OF THE INVENTION

A first embodiment of the present invention, i.e., hanger 10, is shown in FIGS. 1 to 6. Hanger 10 includes a plastic body portion 12 for supporting a garment. Body portion 12 in turn includes a central region 14 and a pair of opposing downwardly-depending arms 16. Hanger 10 further includes a plastic support structure 18 extending from an upper edge of body portion 12. Support structure 18 in turn includes a hook base 20 and a sizer-engaging web 22.

Figure 1:
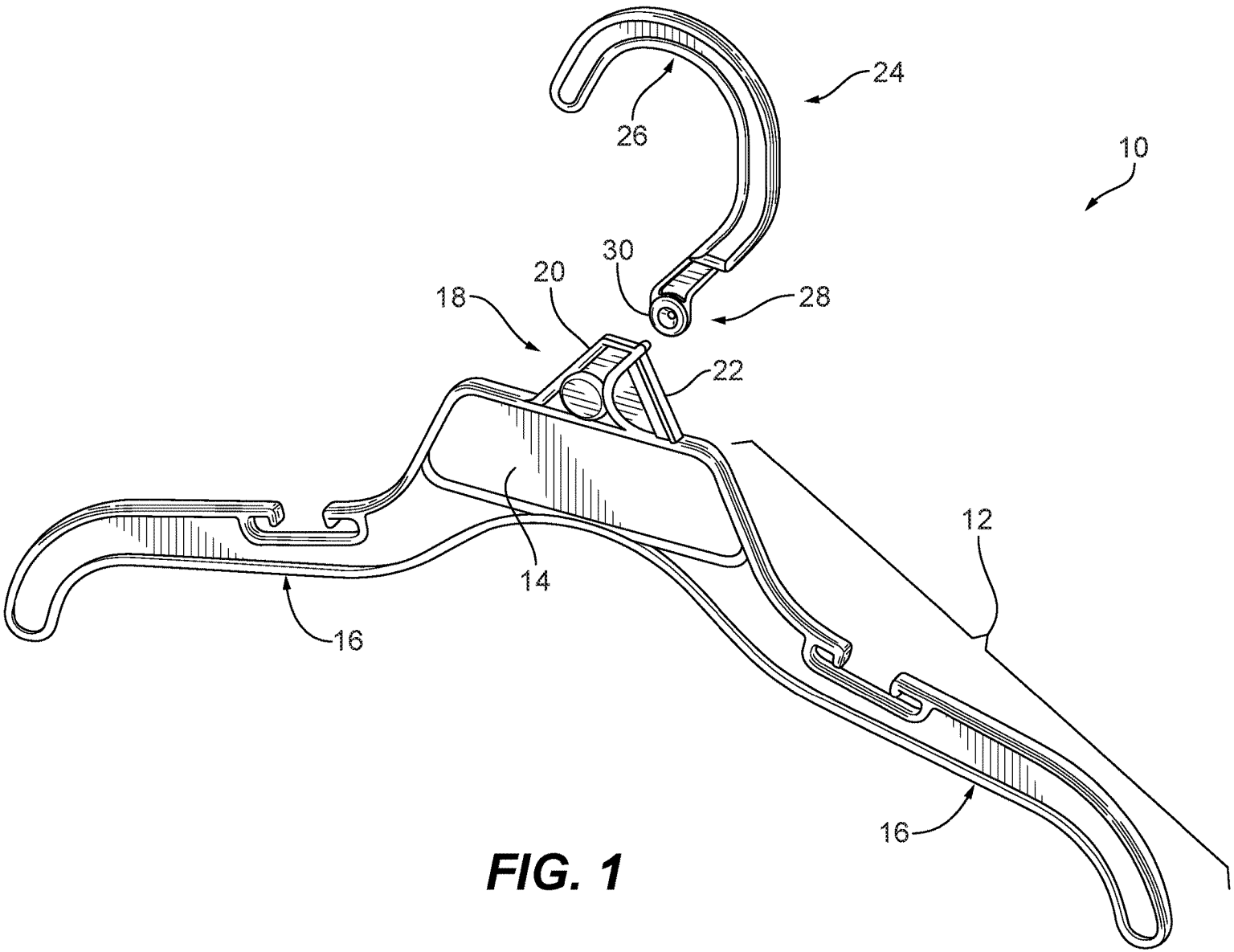
FIG. 1 is a front perspective view of a first embodiment of the plastic garment hanger of the present invention with the plastic hook exploded away from the plastic body.
Figure 2:
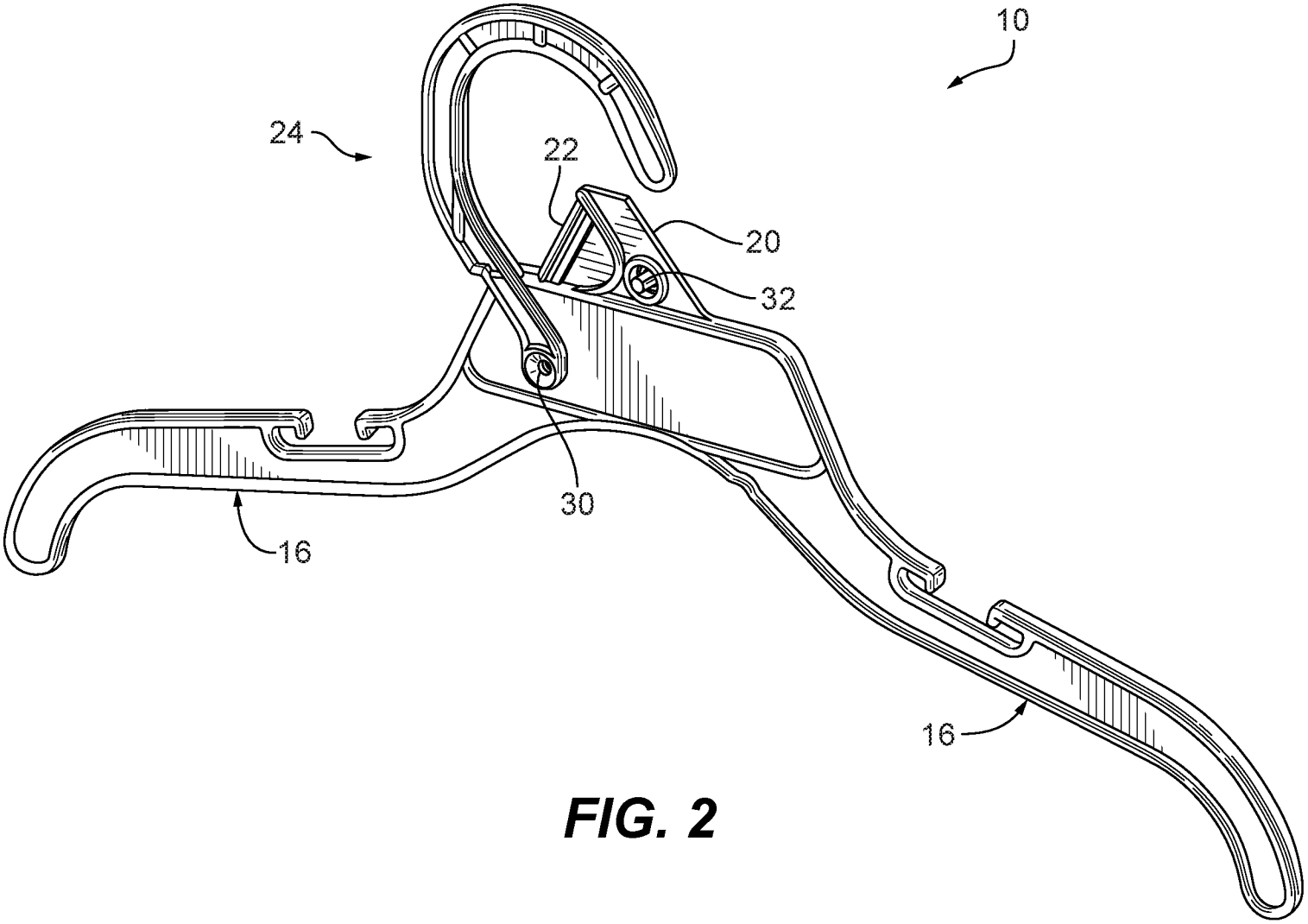
FIG. 2 is a rear perspective view of the plastic garment hanger of FIG. 1 with the plastic hook exploded away from the plastic body.
Figure 3:
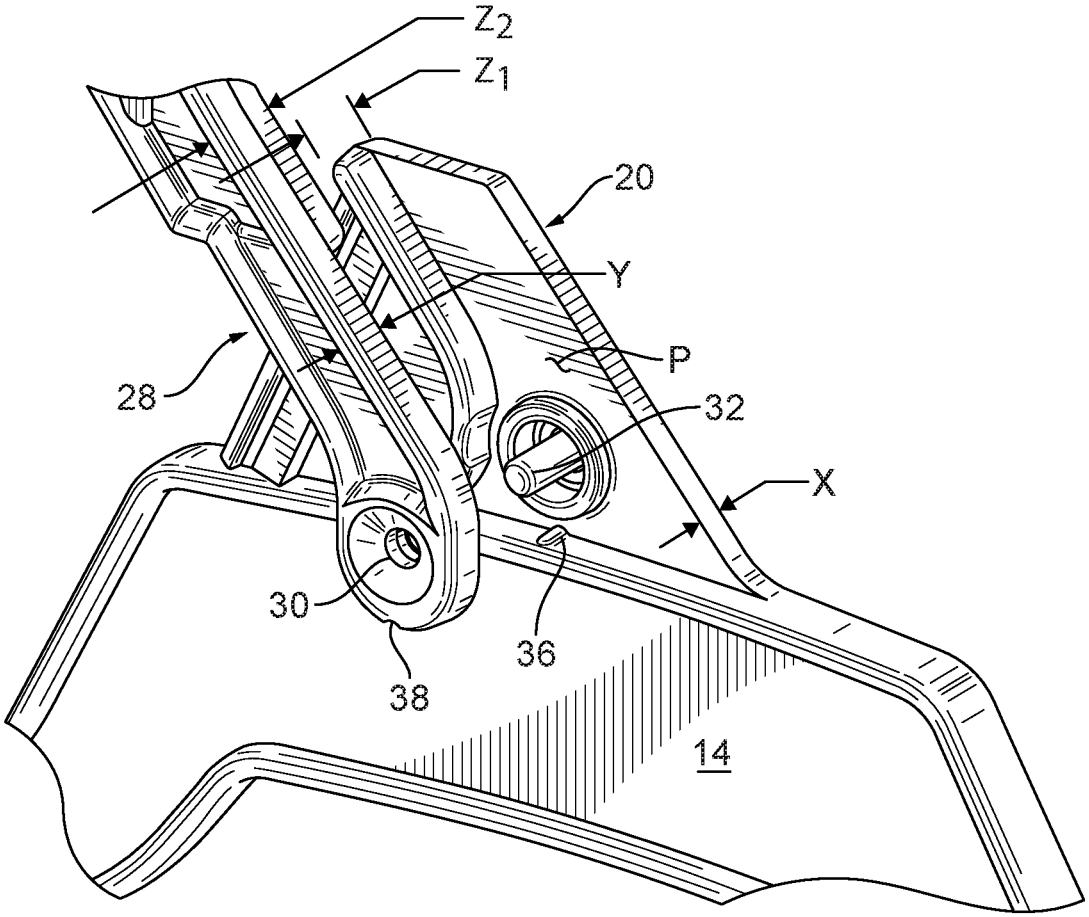
FIG. 3 is an enlarged view taken from FIG. 2.
Figure 4:
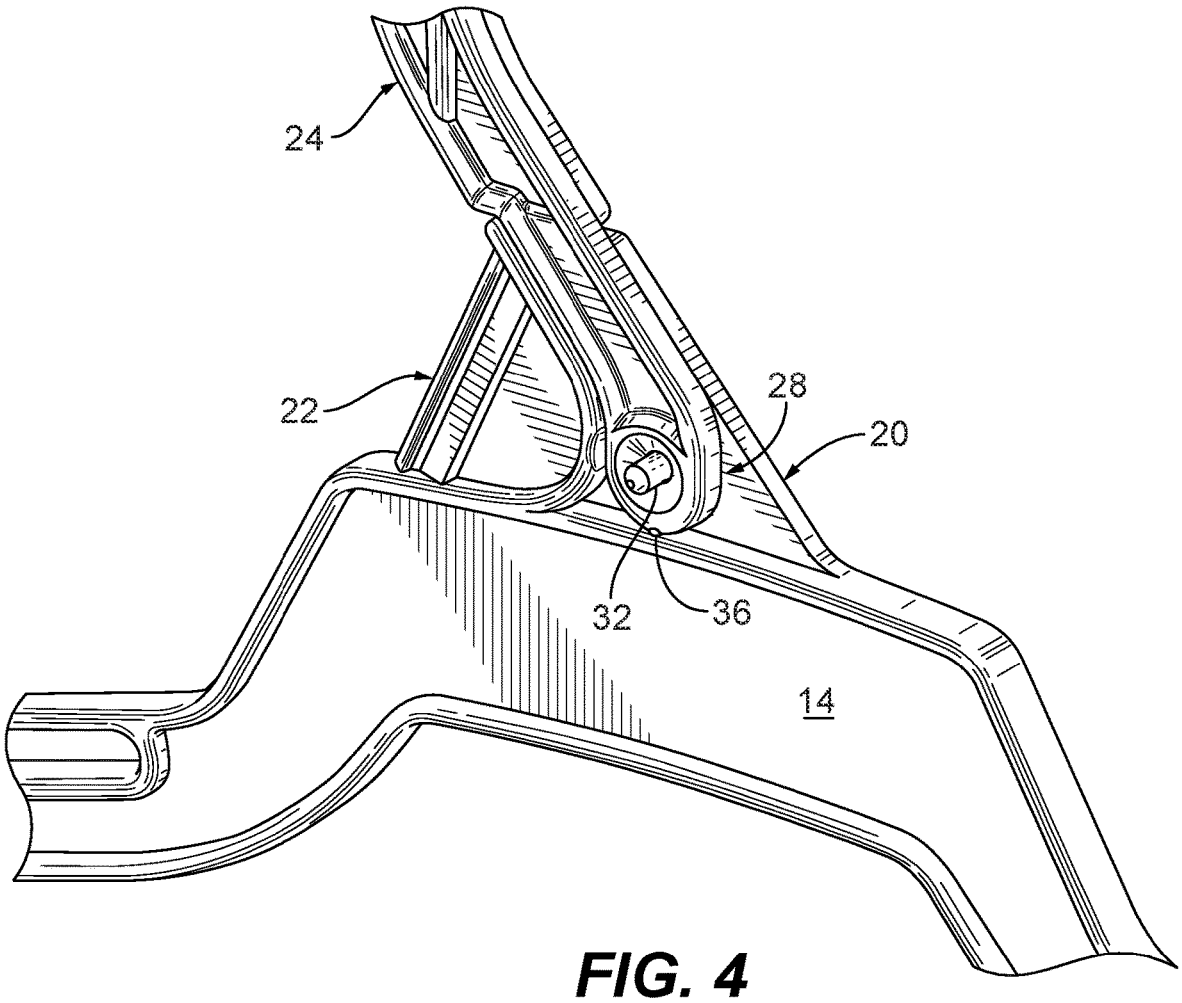
FIG. 4 is a rear perspective view of the plastic garment hanger of FIG. 1 showing the plastic hook positioned for assembly to the plastic hook base.
Figure 5:
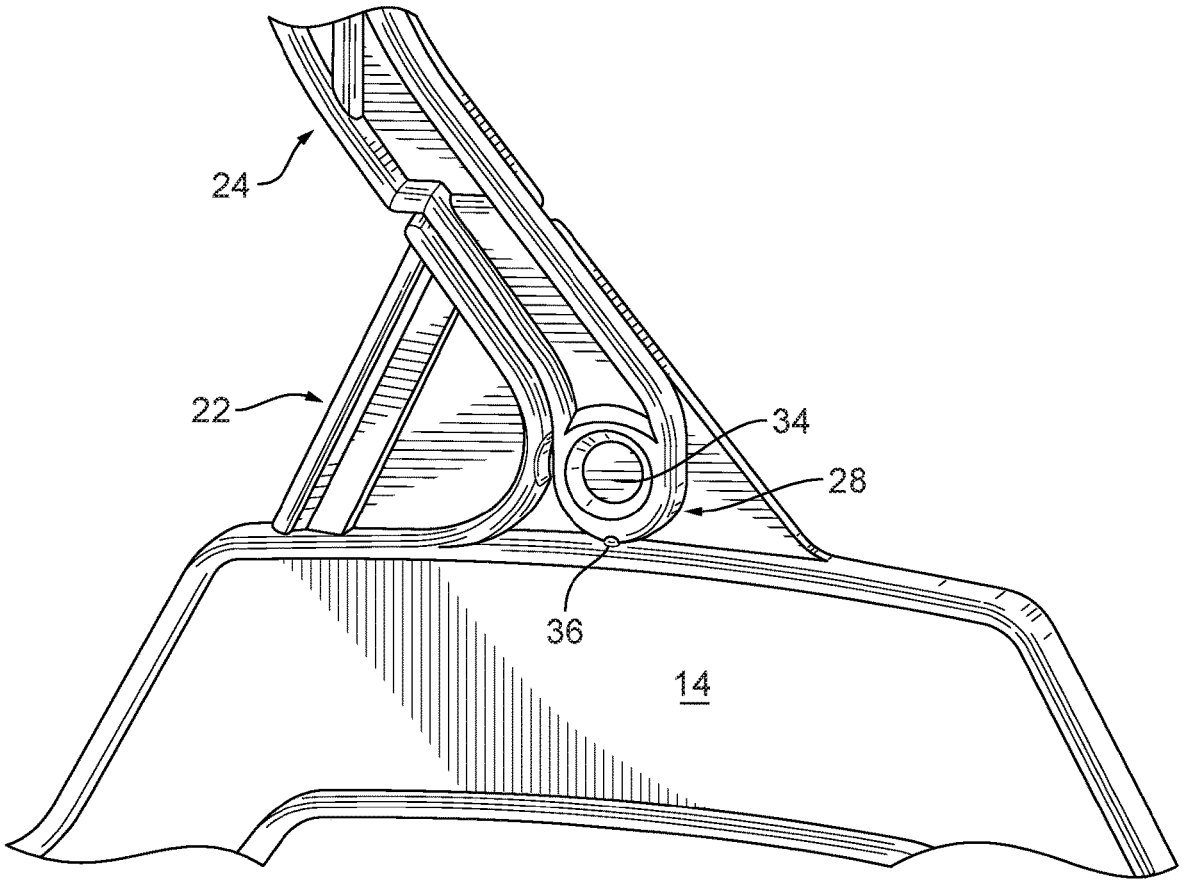
FIG. 5 is a rear perspective view of the plastic garment hanger of FIG. 1 showing the plastic hook non-removably and rotatably connected to the plastic hook base.
Figure 6:
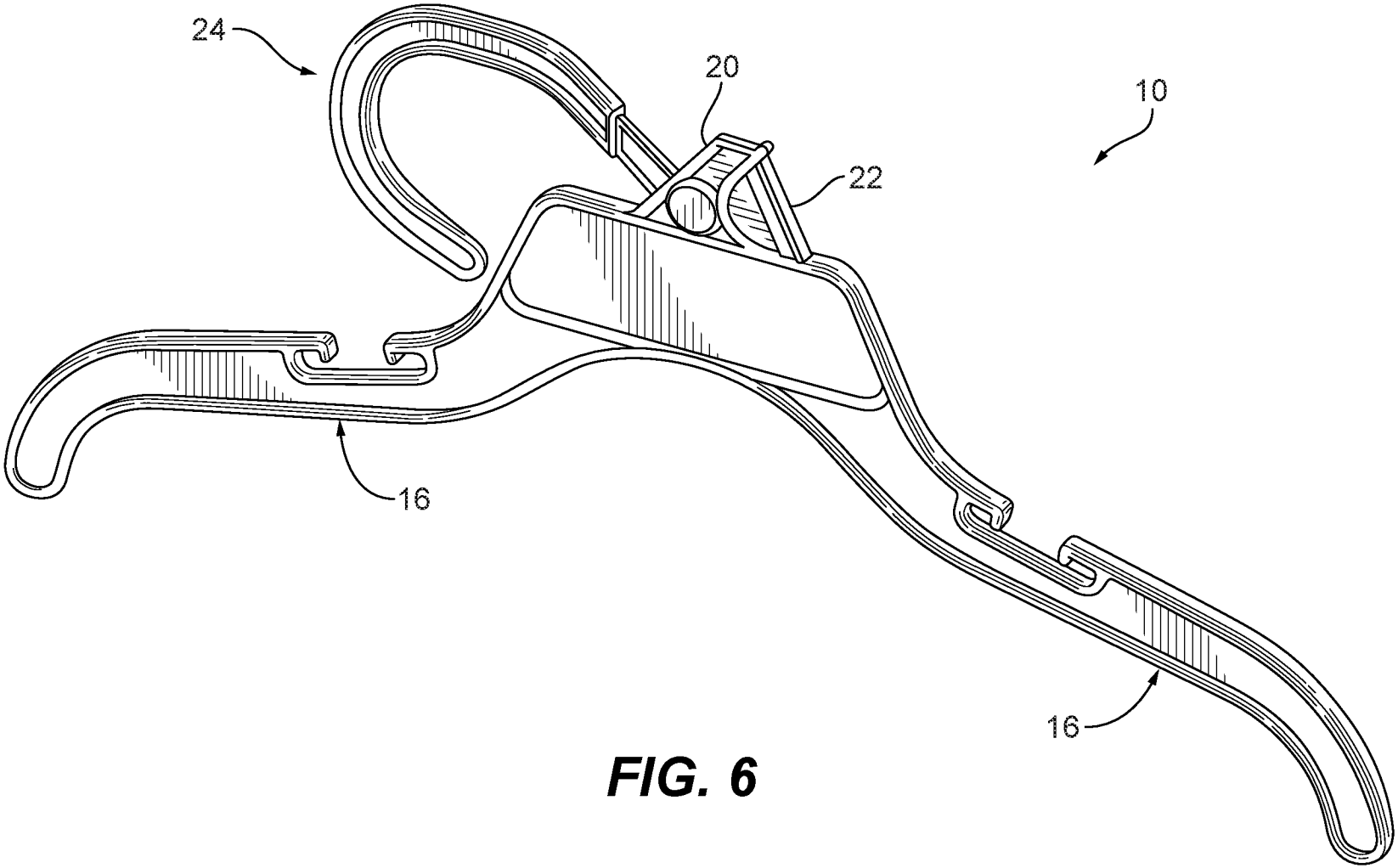
FIG. 6 is a front perspective view of the plastic garment hanger of FIG. 1 showing the plastic hook non-removably and rotatably connected to the plastic body, the plastic hook being shown in the second folded stowage position.
Figure 7:
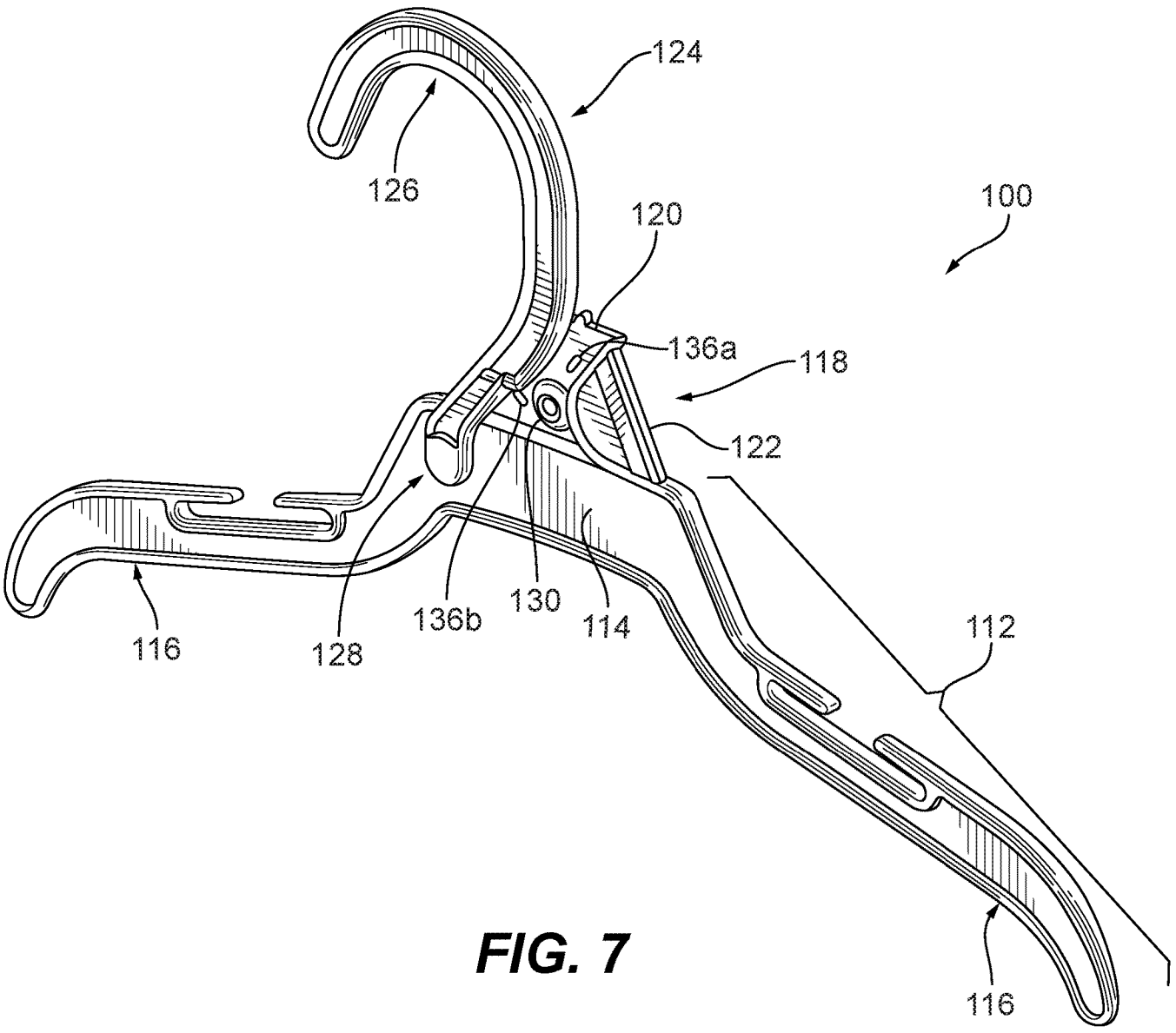
FIG. 7 is a front perspective view of a second embodiment of the plastic garment hanger of the present invention with the plastic hook exploded away from the plastic body.

Hangar 10 further includes a plastic hook 24. Plastic hook 24 in turn includes a rod-engaging end 26 and an opposing base-engaging end 28. An aperture 30 extends through base-engaging end 28. As best seen in FIGS. 2 to 3, a pin 32 extends outward from hook base 20 in a direction perpendicular to a plane P defined by hook base 20. Pin 32 is sized to rotatably extend through aperture 30. In particular, hook 24 is sized and configured to cooperate with support structure 18 whereby pin 32 extends through aperture 30 when base-engaging end 28 of hook 24 is positioned against hook (see FIG. 4).

After base-engaging end 28 of hook 24 is positioned against hook base 20 such that pin 32 extends through aperture 30, pin 32 is deformed to form a head 34 (see FIG. 5) which non-removably and rotatably connects hook 24 to hook base 20. Pin 32 may be deformed via mechanical action and/or the application of heat/pressure. Once hook 24 is rotatably connected to hook base 20, hook 24 may be rotated between a first upright in-use position (see FIG. 5) and a second folded stowage position (see FIG. 6). This folded state provides a reduced footprint for the hangar, thereby reducing the size of the packaging boxes/containers required to transport the garments positioned on the hangers. Once the garments reach the retail location, the pre-hung garments are removed from the boxes/containers, and the hook is rotated from the folded stowage position to the upright in-use position.

As best seen in FIG. 3, base-engaging end 28 of hook 24 has a cross-sectional thickness Y, while hook 24 has an overall cross-sectional thickness $Z_2$. As also shown in FIG. 3, support structure 18 has a cross-sectional thickness $Z_1$, while at least a portion of hook base 20 as a cross-sectional thickness X. In one preferred embodiment, cross-sectional thickness $Z_1$ is substantially equal to cross-sectional thickness $Z_2$, and cross-sectional thickness X+cross-sectional thickness Y is substantially equal to cross-sectional thickness $Z_1$. In this manner, the hook presents a substantially uniform cross-sectional thickness when in the upright in-use position. More to the point, the hanger, and particularly the hook, present the substantially same visual appearance to the customer (as a conventional plastic hook hanger) while in use displaying a garment.

Hanger 10 may also include a locking mechanism for securing the hook in the upright in-use position. In one embodiment, the locking mechanism includes a catch 36 positioned to engage a notch 38 formed in the lower edge of base-engaging end 28 of hook 24 (see FIG. 3). When hook 24 is rotated to the upright in-use position, catch 36 engages notches 38—thus frictionally securing the hook in the upright in-use position. Of course, it is contemplated herein that other mechanically cooperating structure may be located on the hook and/or support structure to secure the hook in one or both of the mentioned positions.

A second embodiment of the present invention, i.e., hanger 100, is shown in FIGS. 7 to 10. Hanger 100 includes a plastic body portion 112 for supporting a garment. Body portion 112 in turn includes a central region 114 and a pair of opposing downwardly-depending arms 116. Hanger 100 further includes a plastic support structure 118 extending from an upper edge of body portion 112. Support structure 118 in turn includes a hook base 120 and a sizer-engaging web 122.

Figure 8:
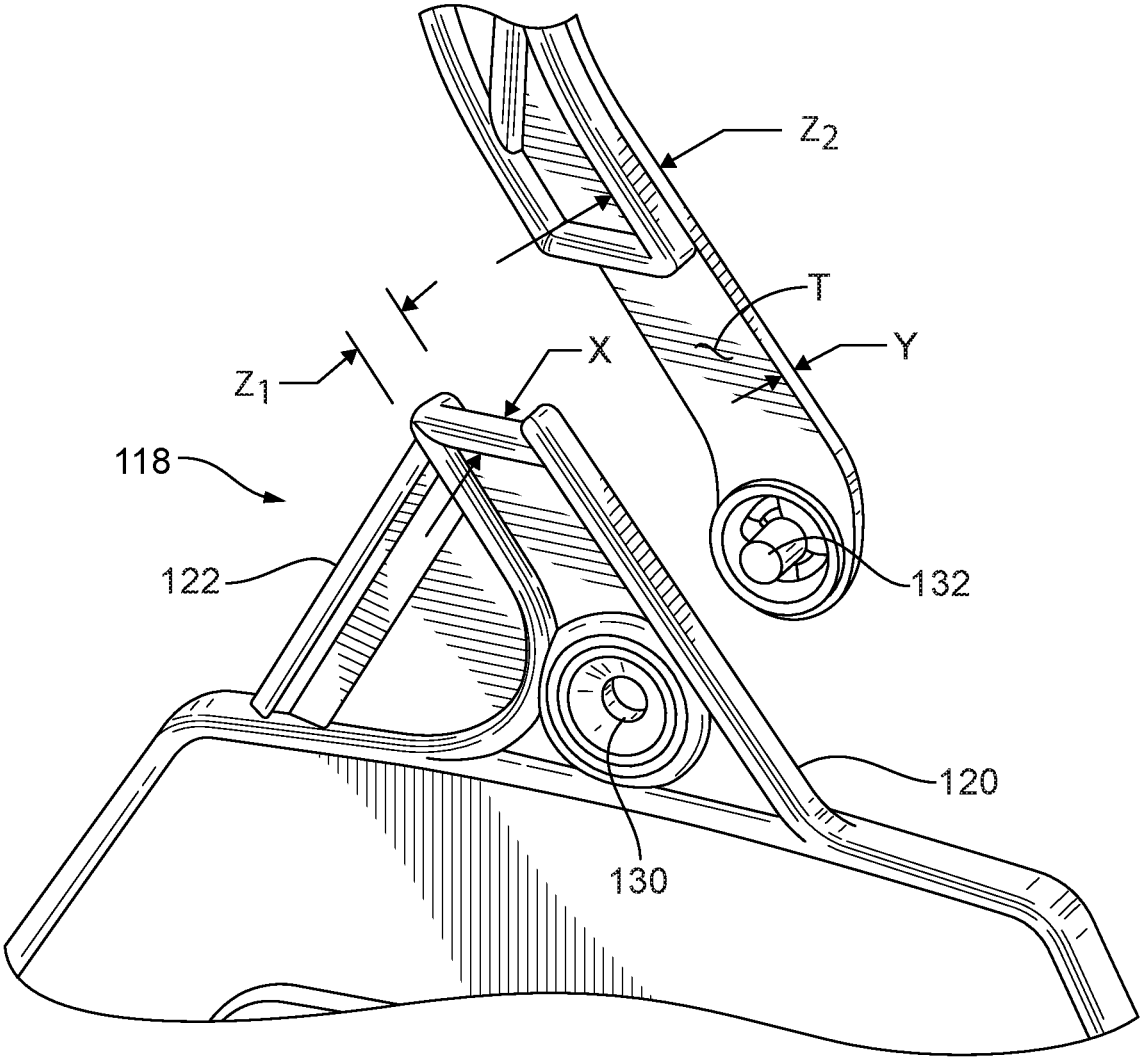
FIG. 8 is a rear perspective view of the plastic garment hanger of FIG. 7 with the plastic hook exploded away from the plastic body.
Figure 9:
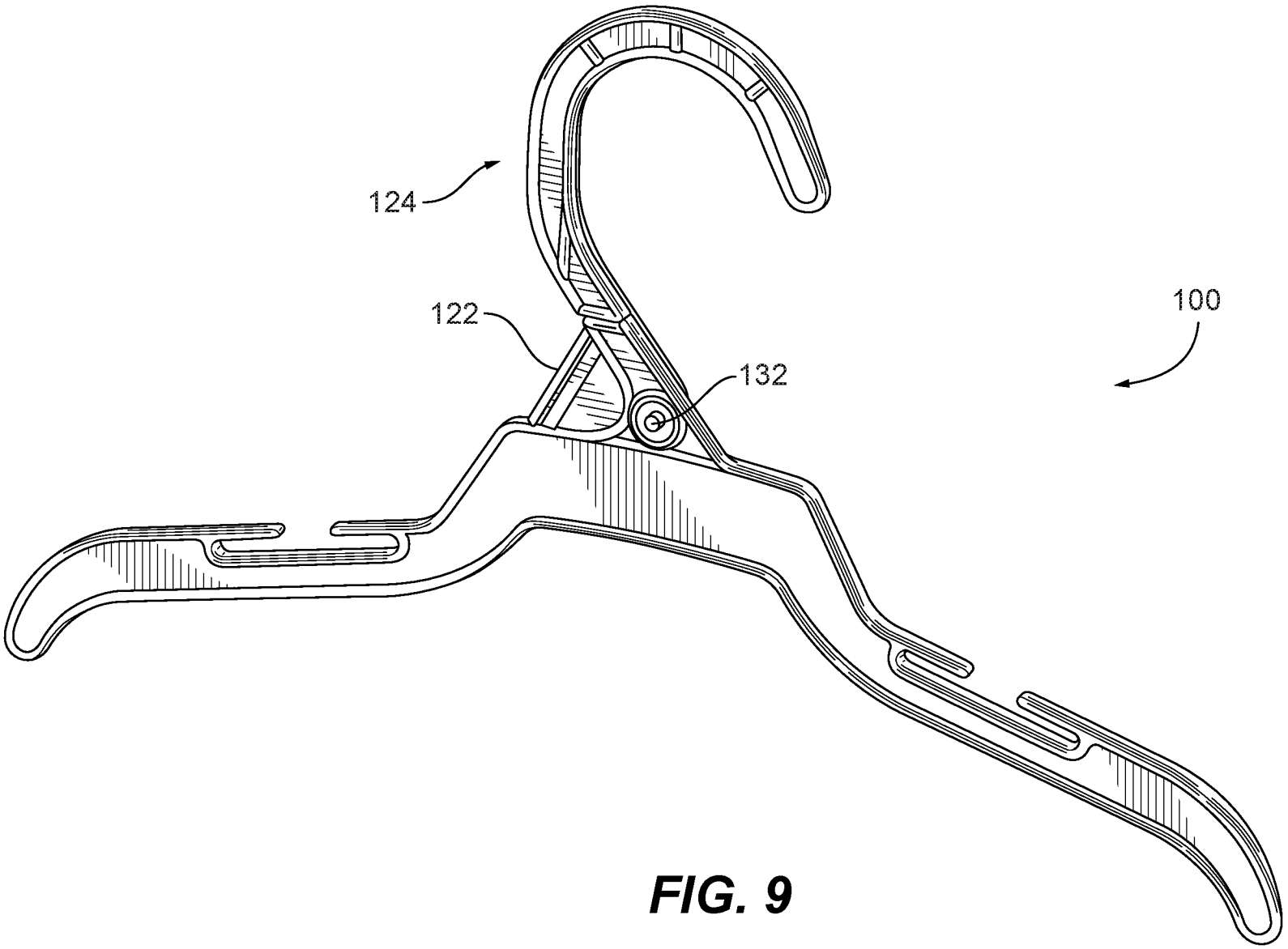
FIG. 9 is a rear perspective view of the plastic garment hanger of FIG. 7 showing the plastic hook positioned for assembly to the plastic hook base.
Figure 10:
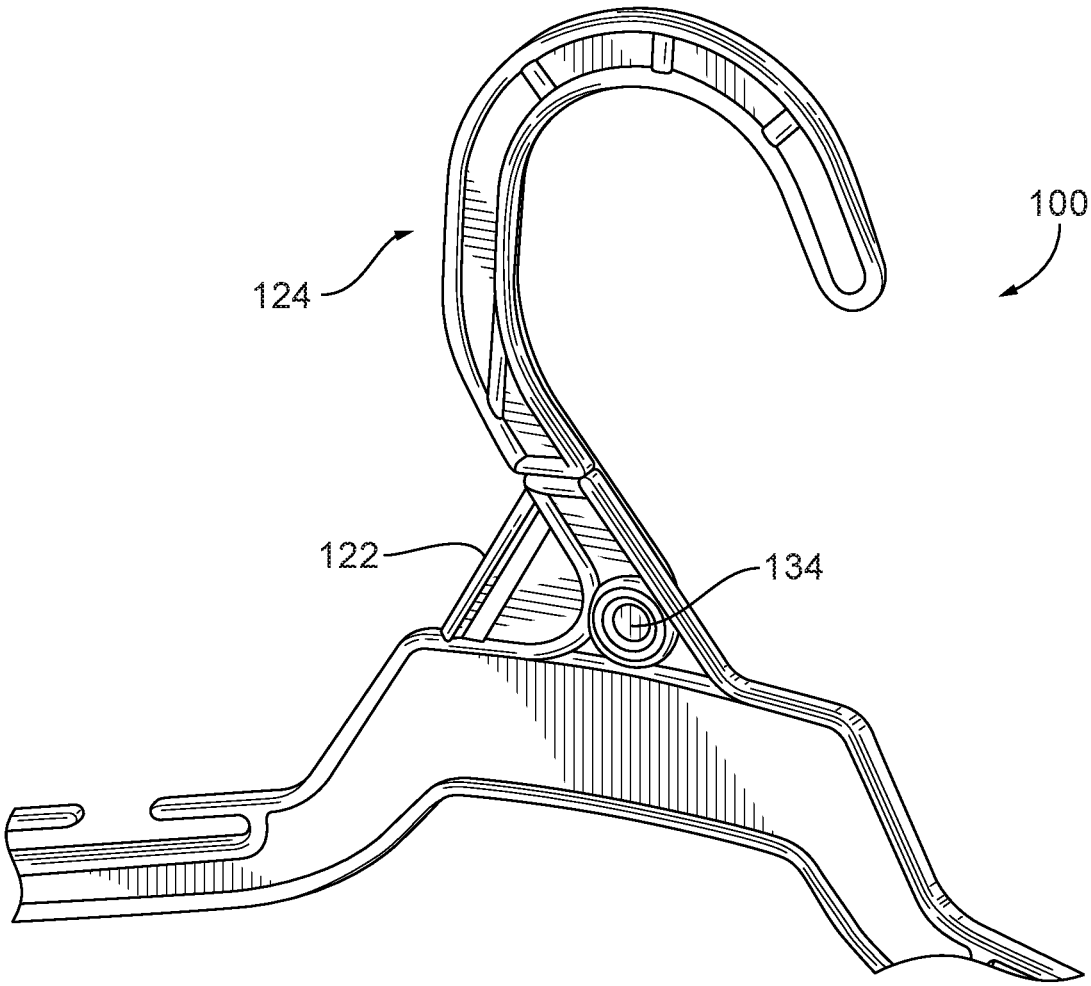
FIG. 10 is a rear perspective view of the plastic garment hanger of FIG. 7 showing the plastic hook non-removably and rotatably connected to the plastic body.

Hanger 100 further includes a plastic hook 124. Plastic hook 124 in turn includes a rod-engaging end 126 and an opposing base-engaging end 128. An aperture 130 extends through hook base 120. As best seen in FIG. 8, a pin 132 extends outward from base-engaging end 128 of hook 124 in a direction perpendicular to a plane T defined by hook 124. Pin 132 is sized to rotatably extend through aperture 130. In particular, hook 124 is sized and configured to cooperate with support structure 118 whereby pin 132 extends through aperture 130 when base-engaging end 128 of hook 124 is positioned against hook base 120 (see FIG. 9)

After base-engaging end 128 of hook 124 is positioned against hook base 120 such that pin 132 extends through aperture 130, pin 132 is deformed to form a head 134 (see FIG. 10) which non-removably and rotatably connects hook 124 to hook base 120. Pin 132 may be deformed via mechanical action and/or the application of heat/pressure. Once hook 124 is rotatably connected to hook base 120, hook 124 may be rotated between a first upright in-use position (see FIG. 10) and a second folded stowage position (not shown).

Hanger 100 may include a locking mechanism for securing the hook in the upright in-use position. In one embodiment, the locking mechanism includes protrusions **136*a* and 136*b* sized to engage at least an edge of said base-engaging end 128 of hook 124. When hook 124 is rotated to the upright in-use position, protrusion 136*a* engages an edge of base-engaging end 128—thus securing the hook in the upright in-use position. When hook 124 is rotated to the folded stowage position, protrusion 136*b* engages the opposing edge of base-engaging end 128**—thus securing the hook in the folded stowage position. Of course, it is contemplated herein that other mechanically cooperating structure may be located on the hook and/or support structure to secure the hook in one or both of the mentioned positions.

As best seen in FIG. 8, base-engaging end 128 of hook 124 has a cross-sectional thickness Y, while hook 124 has an overall cross-sectional thickness $Z_2$. As also shown in FIG. 8, support structure 118 has a cross-sectional thickness $Z_1$, while at least a portion of hook base 120 as a cross-sectional thickness X. In one preferred embodiment, cross-sectional thickness $Z_1$ is substantially equal to cross-sectional thickness $Z_2$, and cross-sectional thickness X+cross-sectional thickness Y is substantially equal to cross-sectional thickness $Z_1$. In this manner, the hanger, and particularly the hook, present the substantially same visual appearance to the customer (as a conventional plastic hook hanger) while in use displaying a garment.

A third embodiment of the present invention, i.e., hanger 200, is shown in FIGS. 11 to 19. Hanger 200 includes a plastic body portion 212 for supporting a garment. Body portion 212 in turn includes a central region 214 and a pair of opposing downwardly-depending arms 216. Hanger 200 further includes a plastic support structure 218 extending from an upper edge of body portion 212. Support structure 218 in turn includes a hook base 220 and a sizer-engaging web 222.

Figure 12:
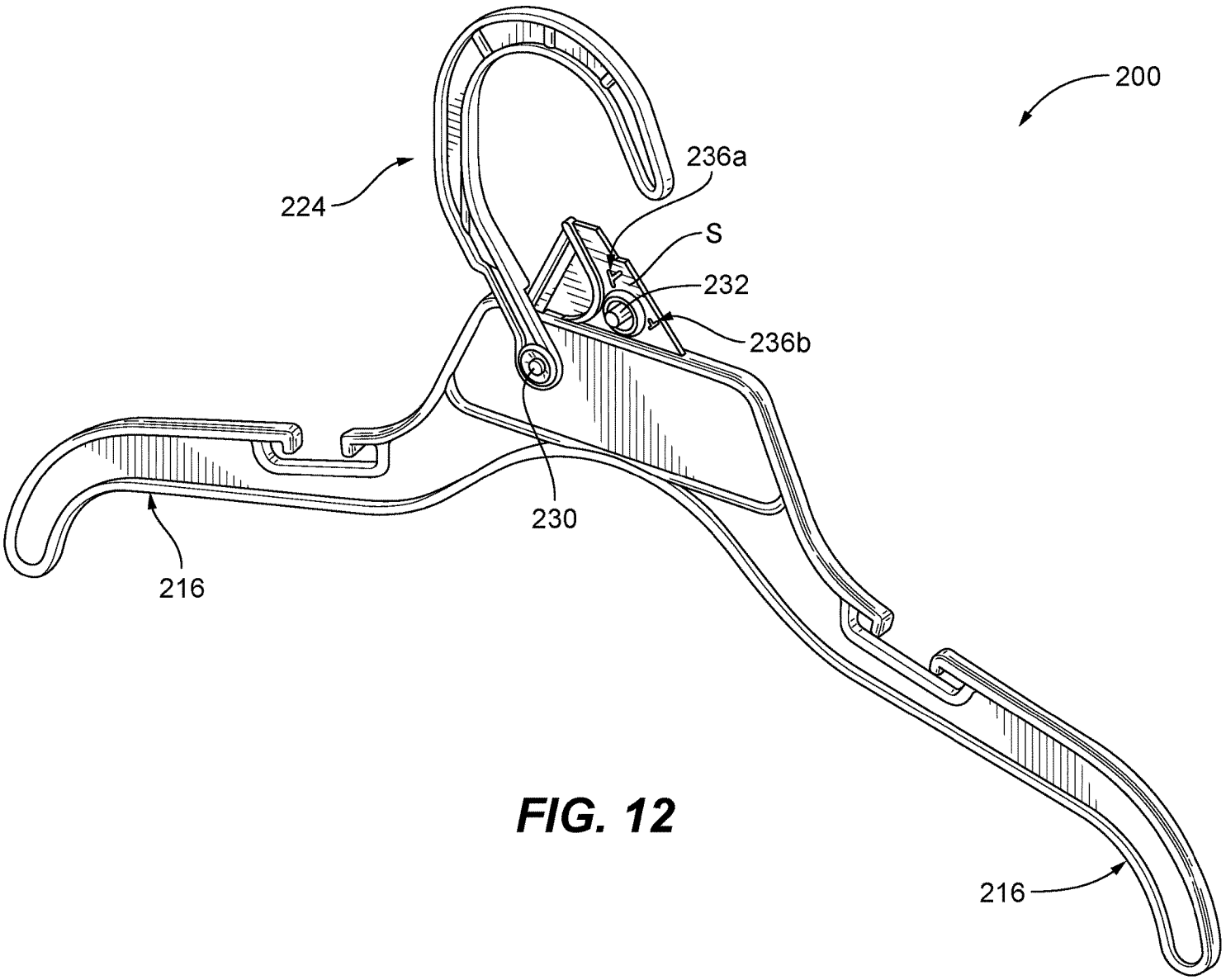
FIG. 12 is a rear perspective view of the plastic garment hanger of FIG. 11 with the plastic hook exploded away from the plastic body.
Figure 13:
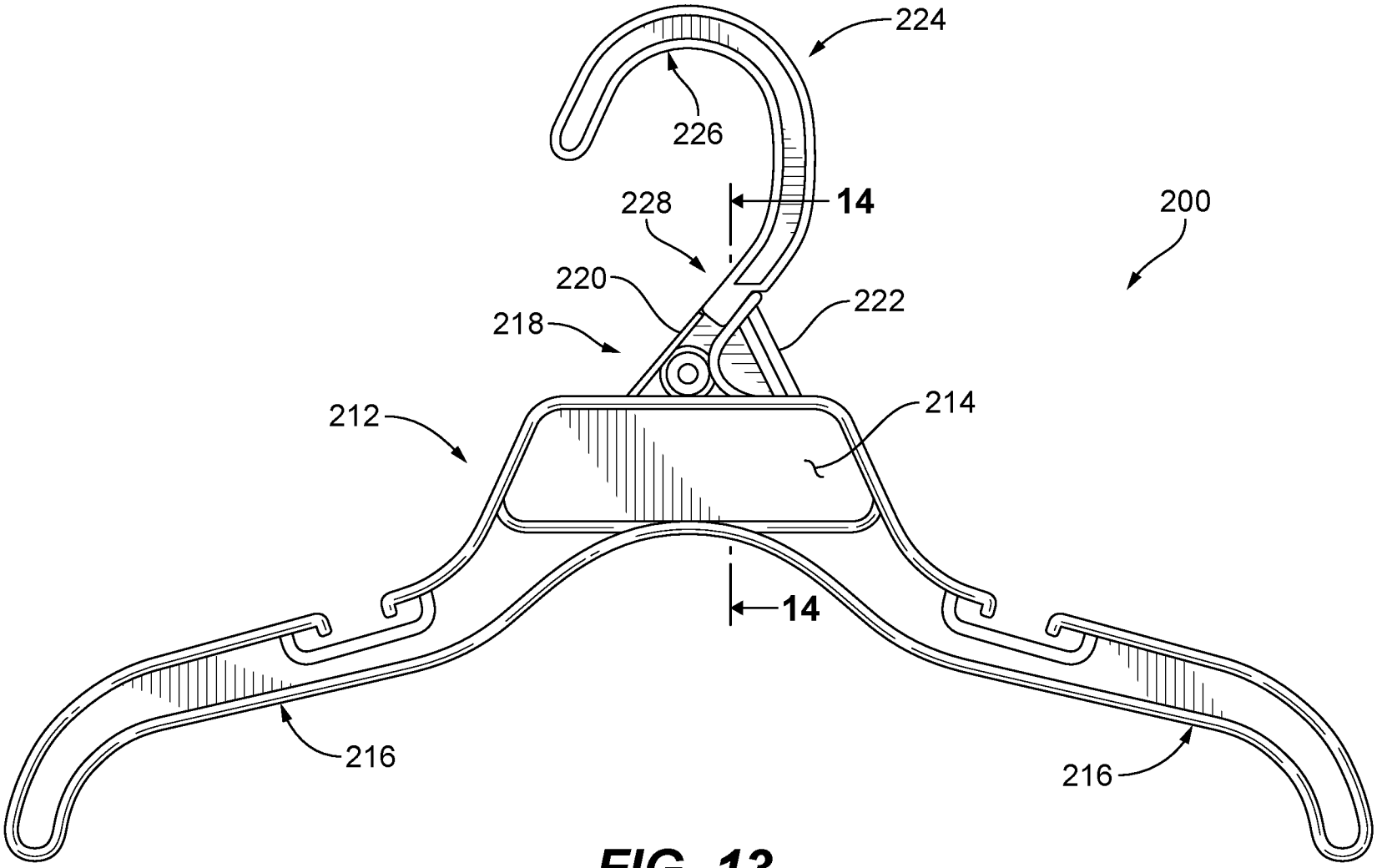
FIG. 13 is a front elevation view of the plastic garment hanger of FIG. 11 showing the hook in the upright in-use position.

Hanger 200 further includes a plastic hook 224. Plastic hook 224 in turn includes a rod-engaging end 226 and an opposing base-engaging end 228. An aperture 230 extends through base-engaging end 228. As best seen in FIG. 12, a pin 232 extends outward from hook base 220 in a direction perpendicular to a plane S defined by hook base 220. Pin 232 is sized to rotatably extend through aperture 230. In particular, hook 224 is sized and configured to cooperate with support structure 218 whereby pin 232 extends through aperture 230 when base-engaging end 228 of hook 224 is positioned against hook base 220. It is contemplated herein that that arrangement of aperture 230 and pin 232 can be reversed as described hereinabove with respect to hanger 100.

After base-engaging end 228 of hook 224 is positioned against hook base 220 such that pin 232 extends through aperture 230, pin 232 is deformed to form a head 234 (see FIG. 17) which non-removably and rotatably connects hook 224 to hook base 220. Pin 232 may be deformed via mechanical action and/or the application of heat/pressure. Once hook 224 is rotatably connected to hook base 220, hook 224 may be rotated between a first upright in-use position (see FIG. 17) and a second folded stowage position (see FIG. 18). This folded position provides a reduced footprint for the hangar, thereby reducing the size of the packaging boxes/containers required to transport the garments positioned on the hangers. Once the garments reach the retail location, the pre-hung garments are removed from the boxes/containers, and the hook is rotated from the folded stowage position to the upright in-use position.

Figure 15:
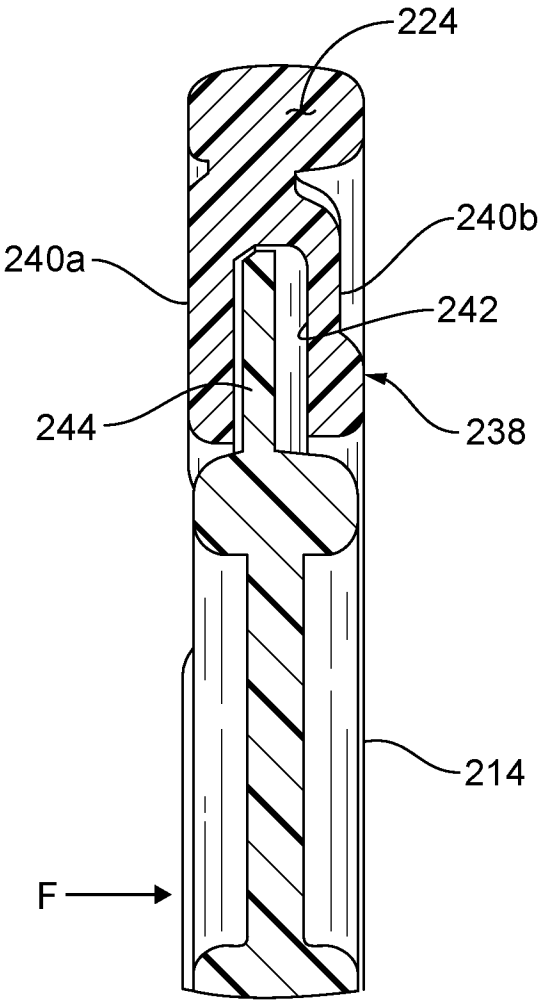
FIG. 15 is an enlarged detail taken from FIG. 14.
Figure 14:
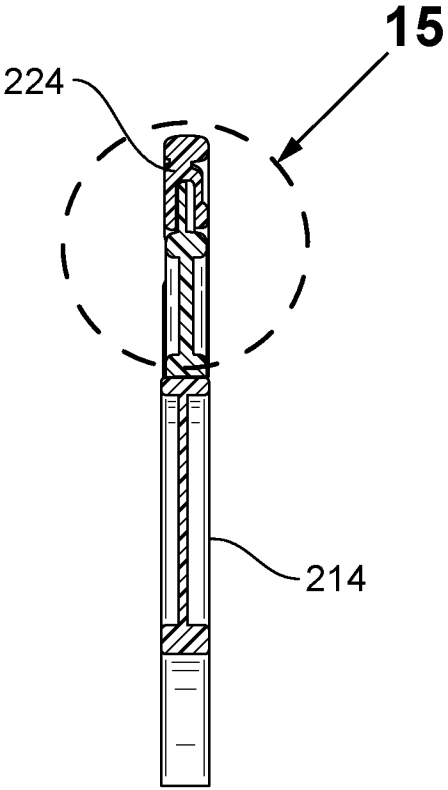
FIG. 14 is a sectional view taken along lines 14-14 of FIG. 13.
Figure 16:
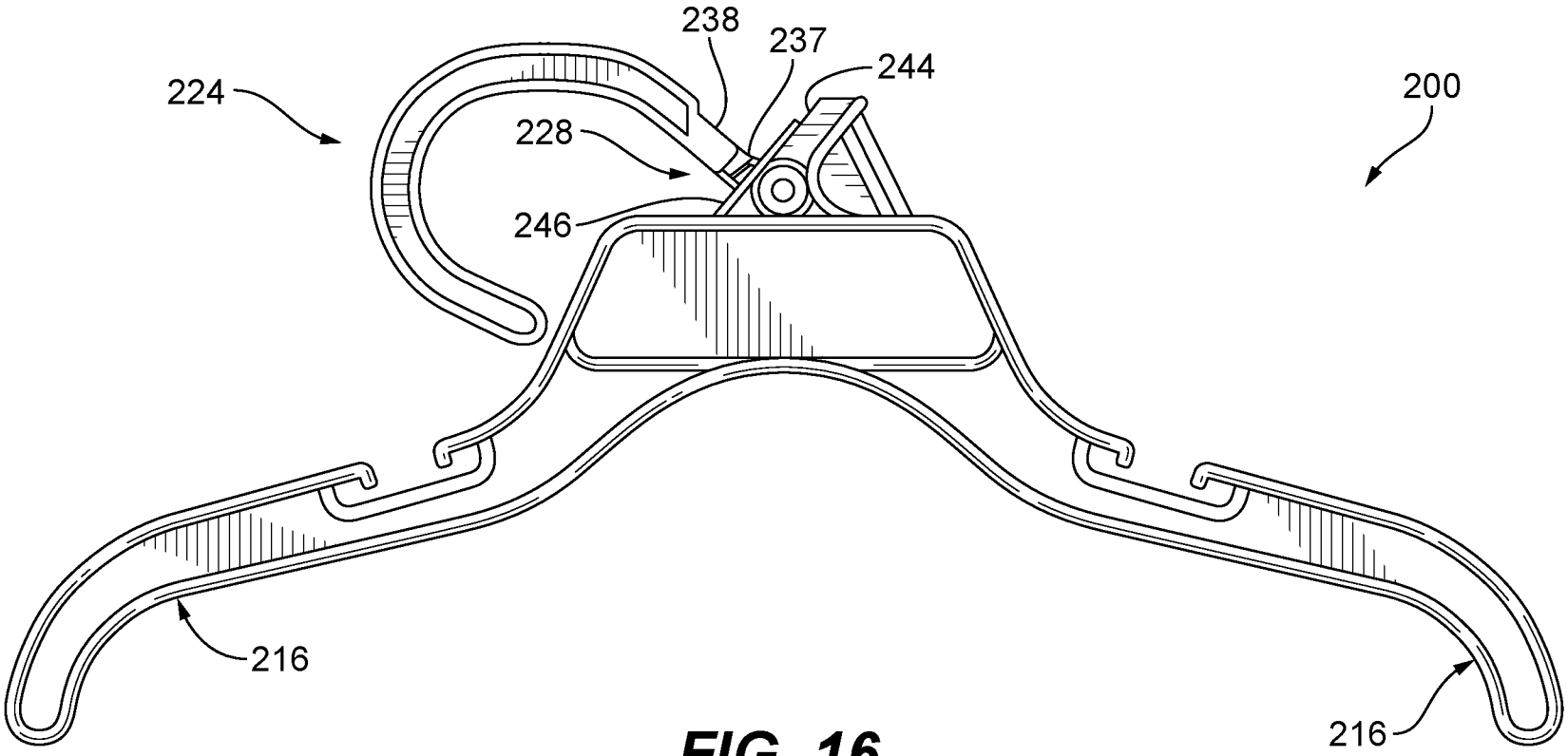
FIG. 16 is a view similar to FIG. 13 showing the hook in the folded stowage position.
Figure 17:
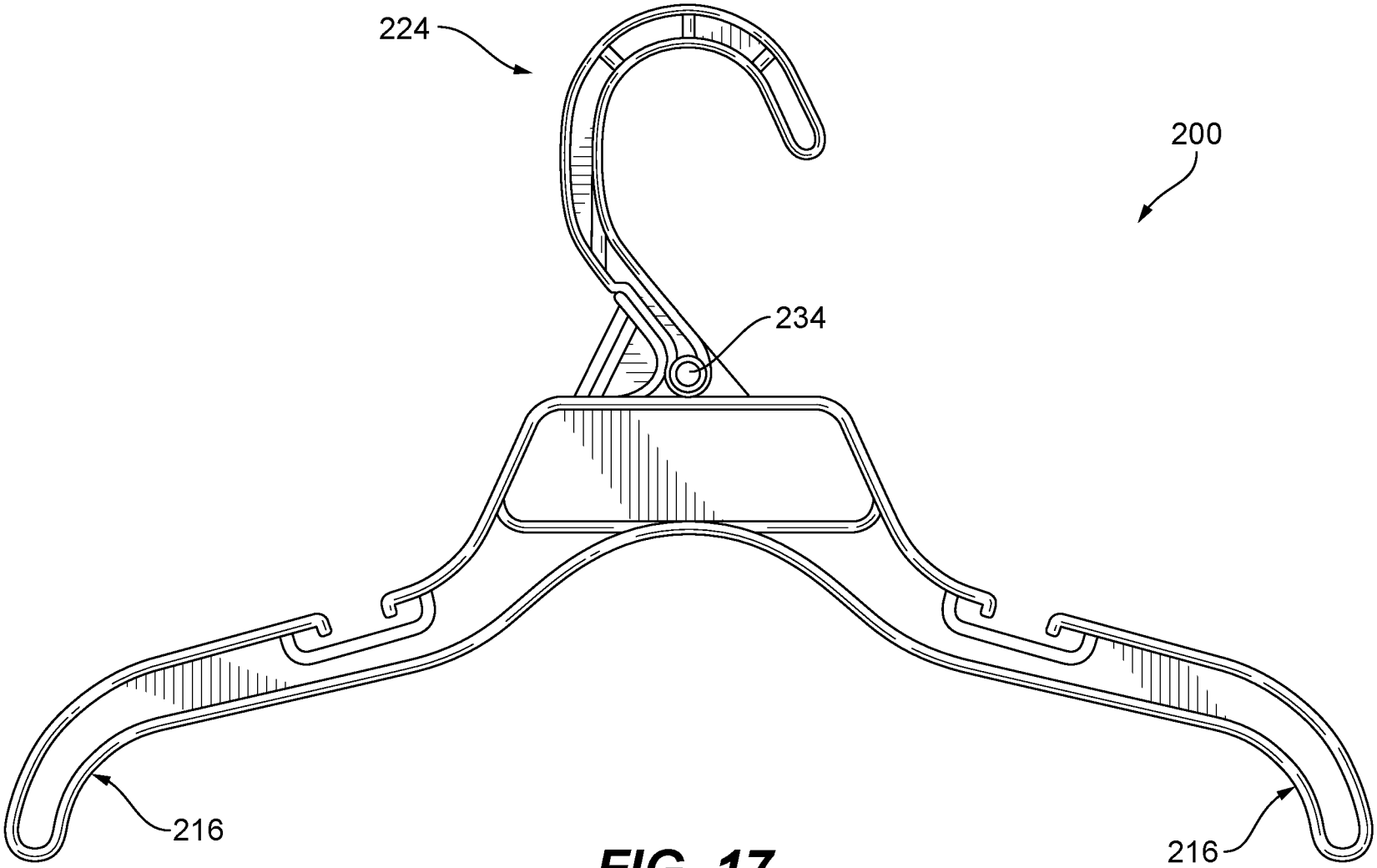
FIG. 17 is a rear elevation view of garment hanger of FIG. 11 showing the hook in the upright in-use position.
Figure 18:
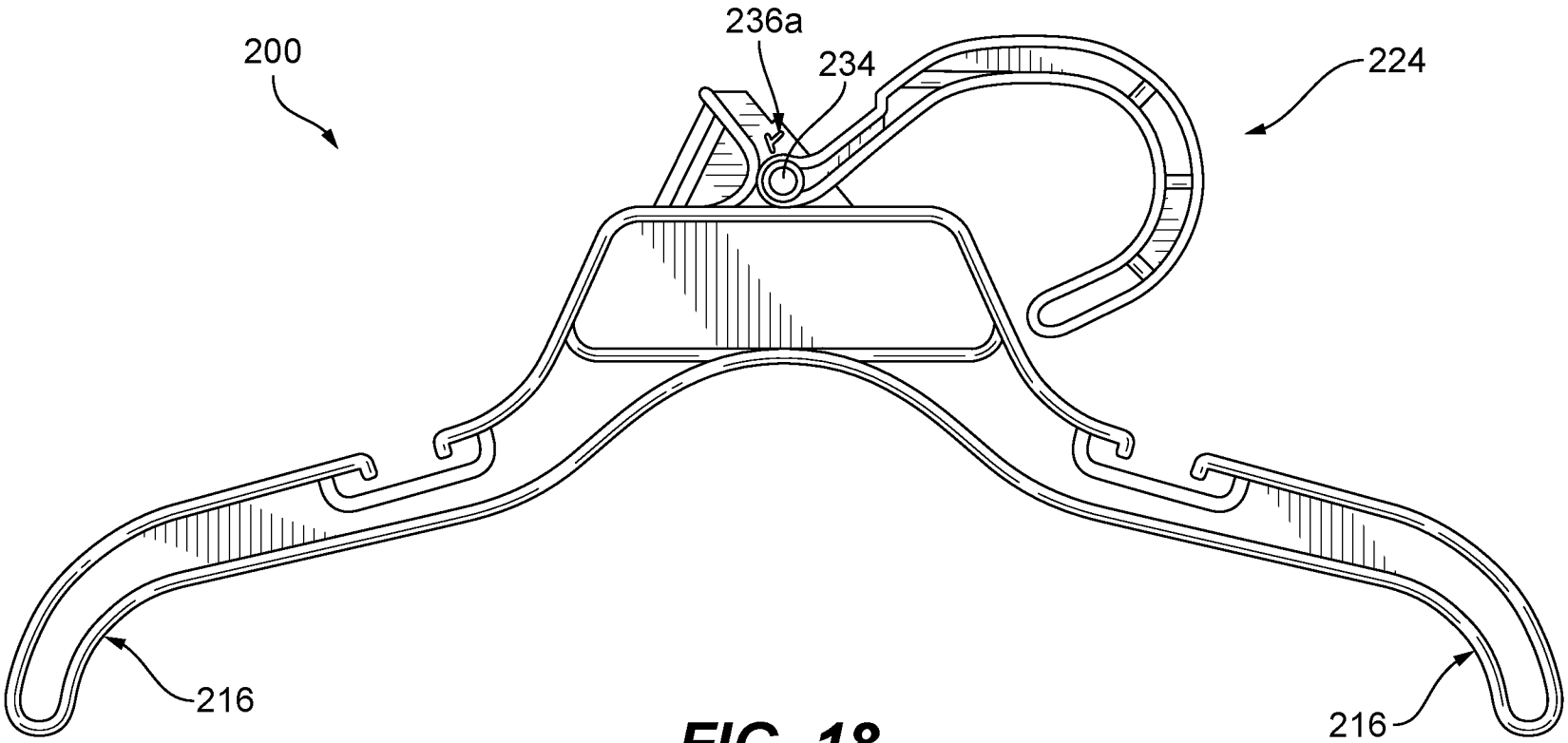
FIG. 18 is a view similar to FIG. 17 showing the hook in the folded stowage position.

As best seen in FIG. 16, base-engaging end 228 of hook 224 includes an attachment section 237. Aperture 230 is preferably located within attachment section 237 of base-engaging end 228. Base-engaging end 228 further includes an edge-engaging section 238 having opposing walls 240*a*, 240*b*, which together define a channel 242 therebetween (see FIG. 15). Channel 242 is preferably sized to receive an engagement edge 244 of support structure 218. As hook 224 is moved from the folded stowage position to the upright in-use position, engagement edge 244 is received within channel 242, thereby providing hook 224 with additional rigidity and strength, particularly against a force F acting in a direction perpendicular to central region 214 of body portion 212 as shown in FIG. 15. As best seen in FIG. 16, a portion of flange 246 is preferably removed from support structure 218, thereby defining engagement edge 244 and allowing engagement edge 244 to be able to travel into and out of channel 242.

As best seen in FIG. 19, hook 224 has an overall cross-sectional thickness $Z_2$, while attachment section 237 of base-engaging end 228 has a cross-sectional thickness Y. Edge-engaging section 238 of base-engaging end 228 has a cross-sectional thickness substantially equal to $Z_2$. As also shown in FIG. 19, support structure 218 has a cross-sectional thickness $Z_1$, while at least a portion of hook base 220 as a cross-sectional thickness X. In one preferred embodiment, cross-sectional thickness $Z_1$ is substantially equal to cross-sectional thickness $Z_2$, and cross-sectional thickness X plus cross-sectional thickness Y is substantially equal to cross-sectional thickness $Z_1$. In this manner, the hook presents a substantially uniform cross-sectional thickness when in the upright in-use position. More to the point, the hanger, and particularly the hook, present the substantially same visual appearance to the customer (as a conventional plastic hook hanger) when in the upright in-use position.

Hanger 200 may include locking mechanisms for securing the hook in the upright in-use position and/or in the folded stowage position. In one embodiment, the locking mechanisms include protrusions 236*a* and 236*b* sized to engage at least an edge of the base-engaging end 228 of hook 224. When hook 224 is rotated to the upright in-use position, protrusion 236*a* engages an edge of base-engaging end 228—thus securing the hook in the upright in-use position. When hook 224 is rotated to the folded stowage position, protrusion 236*b* engages the opposing edge of base-engaging end 228—thus securing the hook in the folded stowage position. Of course, it is contemplated herein that other mechanically cooperating structure may be located on the hook and/or support structure to secure the hook in one or both of the mentioned positions.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

What is claimed is:

1. A garment hanger, comprising:

a plastic body portion for supporting a garment;

a plastic support structure extending from an edge of said body portion, said support structure including a hook base and a sizer-engaging web, a portion of said hook base defining an engagement edge;

a plastic hook having a rod-engaging end and an opposing base-engaging end, said base-engaging end being non-removably and rotatably connected to said hook base, said base-engaging end including a channel sized to receive said engagement edge of said hook base, said hook being rotatable between a first upright in-use position wherein said engagement edge of said hook base is received within said channel of said base-engaging end and a second folded stowage position wherein said engagement edge is separated from said channel; and wherein said rod-engaging end of said hook defines a cross-sectional thickness $Z_2$, and wherein said base-engaging end of said hook includes a first attachment section defining a cross-sectional thickness Y and a second edge-engaging section defining a cross-sectional thickness substantially equal to $Z_2$, said channel being located within said second edge-engaging section of said base-engaging end of said hook; and wherein said hook base includes a first side and an opposing second side, said hook being rotatably connected to said second side only of said hook base, said hook base including a flange extending along an outer edge thereof and terminating at a predetermined location to define said engagement edge, and wherein said flange does not extend within said channel when said hook is in said first upright in-use position.

2. The garment hanger according to claim 1, wherein said plastic support structure defines an overall cross-sectional thickness $Z_1$ and at least a portion of said hook base defines a cross-sectional thickness X, and wherein $X<Z_1$; and and wherein $Z_1$ is substantially equal to $Z_2$, and wherein X plus Y is substantially equal to $Z_1$.

3. The garment hanger according to claim 1, wherein said hook base includes a pin and said base-engaging end of said hook includes an aperture sized to rotatably receive said pin whereby said hook is rotatably connected to said base.

4. The garment hanger according to claim 3, wherein said pin includes a deformable head for non-removably securing said hook to said base.

5. The garment hanger according to claim 1, wherein said base-engaging end of said hook includes a pin and said hook base includes an aperture sized to rotatably receive said pin whereby said hook is rotatably connected to said base.

6. The garment hanger according to claim 5, wherein said pin includes a deformable head for non-removably securing said hook to said base.

7. The garment hanger according to claim 1, further comprising a locking mechanism for securing said hook in said first upright in-use position.

8. The garment hanger according to claim 7, wherein said hook base defines a plane P, and wherein said locking mechanism includes a protrusion extending outward from said plane P, said protrusion sized to engage at least an edge of said base-engaging end of said hook when said hook is rotated to said first upright in-use position.

9. A garment hanger, comprising:

a plastic body portion for supporting a garment, said body portion including a central region and a pair of opposing downwardly-depending arms extending therefrom, said body portion forming a continuous unitary structure wherein said arms are fixed with respect to one another;

a plastic support structure extending from an upper edge of said central region, said support structure including a hook base and a sizer-engaging web, a portion of said hook base defining an engagement edge;

a plastic hook having a rod-engaging end and an opposing base-engaging end, said base-engaging end being non-removably and rotatably connected to said hook base, said base-engaging end including a channel sized to receive said engagement edge of said hook base, said hook being rotatable between a first upright in-use position wherein said engagement edge of said hook base is received within said channel of said base-engaging end and a second folded stowage position wherein said engagement edge is separated from said channel;

wherein said rod-engaging end of said hook defines a cross-sectional thickness $Z_2$, and wherein said base-engaging end of said hook includes a first attachment section defining a cross-sectional thickness Y and a second edge-engaging section defining a cross-sectional thickness substantially equal to $Z_2$, said channel being located within said second edge-engaging section of said base-engaging end of said hook;

a locking mechanism for securing said hook in said first upright in-use position;

wherein said hook base defines a plane P, and wherein said locking mechanism includes a protrusion extending outward from said plane P, said protrusion sized to engage at least an edge of said base-engaging end of said hook when said hook is rotated to said first upright in-use position.

* * * * *